US007500510B2

(12) United States Patent
von Wyl et al.

(10) Patent No.: US 7,500,510 B2
(45) Date of Patent: Mar. 10, 2009

(54) OSCILLATING DEVICE FOR CONTINUOUS CASTING MOLDS FOR CASTING MOLTEN METAL

(75) Inventors: Horst von Wyl, Duisburg (DE); Joern Hoffmeister, Moers (DE); Alfons Krausa, Schermbeck (DE); Ulrich Snadny, Oer-Erkenschwick (DE); Ingo Schuster, Willich (DE)

(73) Assignee: SMS Demag AG, Duesseldorf (DE)

( * ) Notice: Subject to any disclaimer, the term of this patent is extended or adjusted under 35 U.S.C. 154(b) by 2 days.

(21) Appl. No.: 11/578,488

(22) PCT Filed: Mar. 15, 2005

(86) PCT No.: PCT/EP2005/002721

§ 371 (c)(1),
(2), (4) Date: Oct. 14, 2006

(87) PCT Pub. No.: WO2005/105341

PCT Pub. Date: Nov. 10, 2005

(65) Prior Publication Data

US 2007/0209775 A1 Sep. 13, 2007

(30) Foreign Application Priority Data

Apr. 16, 2004 (DE) ..... 10 2004 018 602

(51) Int. Cl.
*B22D 11/051* (2006.01)
*B22D 11/053* (2006.01)

(52) U.S. Cl. ..... 164/416; 164/478

(58) Field of Classification Search ..... 164/478, 164/416
See application file for complete search history.

(56) References Cited

U.S. PATENT DOCUMENTS

| | | | | |
|---|---|---|---|---|
| 5,201,909 | A * | 4/1993 | Von Wyl et al. | 164/418 |
| 5,771,957 | A * | 6/1998 | Von Wyl et al. | 164/416 |
| 6,138,743 | A | 10/2000 | Zajber et al. | |
| 6,550,527 | B1 * | 4/2003 | Thoene et al. | 164/416 |
| 2003/0010470 | A1 * | 1/2003 | Fischer et al. | 164/416 |
| 2006/0048915 | A1 * | 3/2006 | Fest et al. | 164/416 |

FOREIGN PATENT DOCUMENTS

| | | | |
|---|---|---|---|
| DE | 2248066 | | 4/1974 |
| EP | 0162191 | | 11/1985 |
| EP | 0425880 | | 5/1991 |
| EP | 1086762 | | 3/2001 |
| JP | 58021034 | A * | 2/1983 |
| JP | 02145321 | A * | 6/1990 |

* cited by examiner

*Primary Examiner*—Kuang Lin
(74) *Attorney, Agent, or Firm*—Abelman, Frayne Schwab

(57) ABSTRACT

An oscillating device for continuous casting molds (1) for casting molten metal particularly, molten steel material includes a plurality of springs (5) or spring assemblies (5*a*) extending between a stationary mold frame (2) and connection or fixing points (4) for supporting a continuous casting mold (1) and are set in control oscillations such as, e.g., resonance oscillations by drive pairs, wherein by using of springs (5), spring assemblies (5*a*) or spring bundles (5*b*) formed of fiber composites (6), damaging corrosion by chemicals during continuous casting is prevented.

7 Claims, 2 Drawing Sheets

OSCILLATING DEVICE FOR CONTINUOUS CASTING MOLDS FOR CASTING MOLTEN METAL

BACKGROUND OF THE INVENTION

1. Field of the Invention

The invention relates to an oscillating device for continuous casting molds for casting molten metal particularly, molten steel material and including a plurality of springs or spring assemblies extending between a stationary mold frame and connection or fixing points for supporting a continuous casting mold and set in control oscillations such as, e.g., resonance oscillations by drive pairs.

2. Description of the Prior Art

Oscillating devices, which are secured to stationary frames with steel plate springs, are known.

The plate springs are designed with a lasting fatigue strength. As a rule, such plate spring suspensions operate for an extended operational time without maintenance. The continuous casting molds are guided in stationary frame with two plate springs per side. The continuous casting molds are supported by the spring force of the plate springs. This construction forms a backlash-free suspension and does not require any maintenance-intensive supports. The guidance of a continuous casting mold along a predetermined path and to a predetermined position is effected without any difficulty. The plate springs, however, greatly influence the oscillation modes because the spring constants should be very large in order to support the weight of the continuous casting mold. In the simplest case, a sinusoidal oscillation mode with the frequency of the natural resonance of a spring-mass system is carried out. Advantageously, a definite guidance of a continuous casting mold is insured with a very stiff plate spring. Oscillation frequency variations or an extended use can lead to reaction forces that cannot be controlled under existing circumstances and which overload the system. In addition, such steel plate spring systems are subjected to an increased corrosion which contributes substantially to failure of the system. Up to the present, springs made of steel and with different corrosion protection layers were used. However, coating is sensitive to mechanical influences when used as a base material. The use of alloyed steels did not eliminate these drawbacks. A satisfactory solution for eliminating these drawbacks could not be found up to the present, let alone effective measures for preventing failure.

The object of the invention is to provide, while eliminating the described drawbacks, a long-lasting, stable, plate spring oscillating device better suitable for casting of molten steel at corresponding oscillation modes.

SUMMARY OF THE INVENTION

The object of the invention is achieved by using springs, spring assemblies or spring bundles formed of fiber composites having operational temperatures of about 20-80° C., high corrosion resistance, high lasting fatigue strength, mechanical stability at a given stiffness, and mechanical characteristics similar to those of spring steel.

The fiber composites prevent corrosion. Thereby, no premature weakening of the plate spring cross-section takes place. Another advantage is protection against chemicals used during continuous casting. In addition, it is possible to produce cross-sections deviating from a rectangular cross-section dependent on the length. The basic form of resonance oscillations that proved itself in last years can be retained.

According to one embodiment, separate or all spring, spring assemblies, or spring bundles are formed of fiber composites.

According to further features, springs, spring assemblies, or spring bundles can be formed without or with a coating.

Suitable materials are selected in such a way that the used fiber composite material consists of carbon fibers (CFK-carbon fiber-reinforced plastic) or aramide fibers (AFK-aramide fiber-reinforced plastic) bonded in plastic material as matrix material.

Another alternative composition consists in that carbon is used as a matrix material.

In order to prevent an excessive force transfer at fixing points, it is suggested that ends of the springs, spring assemblies, or spring bundles be flanged in opposite directions and latched in a fixing point.

A mechanical protection that also works against an excessive thermal loading is obtained when the springs, spring assemblies or spring bundles are encased or are protected with a thin ceramic coating.

It is further advantageous when, with such construction, for eliminating a danger of overflow of molten steel in the region of the spring attachment, the springs, spring assemblies and spring bundles are formed of a fiber composite with ceramic components integrated in the matrix material.

Eventual necessary attachable or accessory components are taken care of in that for maintaining a minimal distance between the plurality of springs, spring assemblies or spring bundles, intermediate layers are laminated in.

BRIEF DESCRIPTION OF THE DRAWINGS

The drawings show embodiments of the invention which would be described in detail below.

It is shown in.

DETAILED DESCRIPTION OF THE PREFERRED EMBODIMENT

Figure 1:
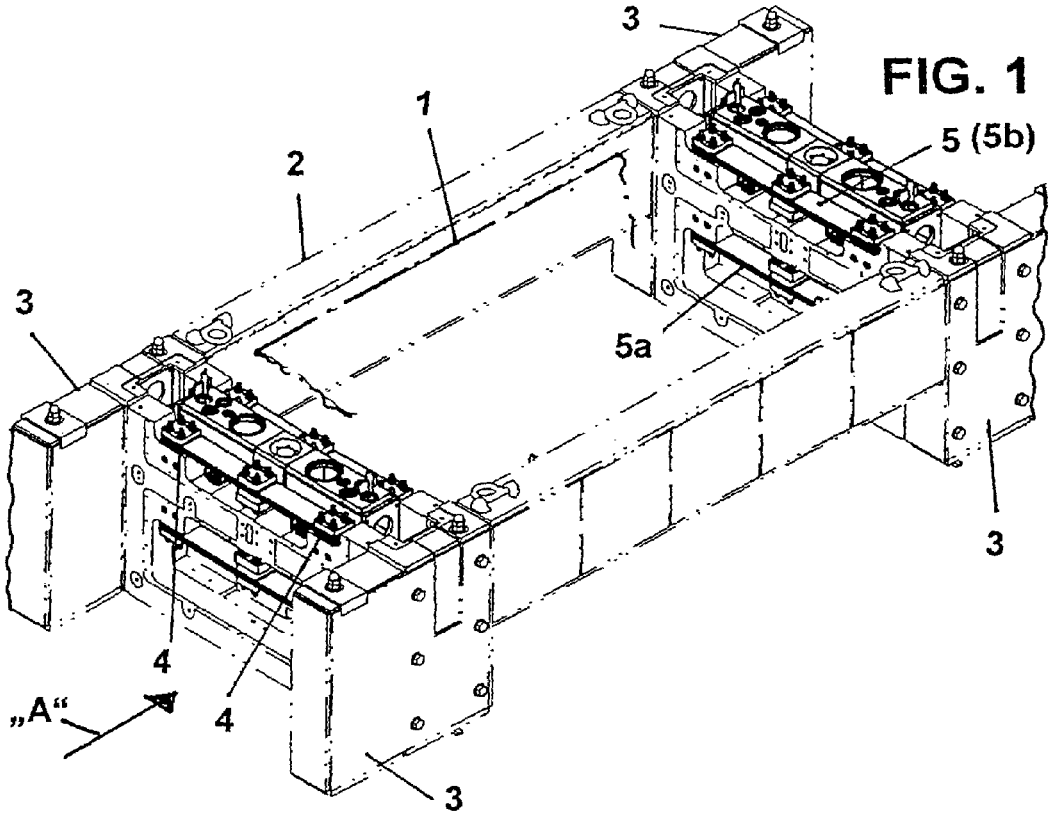
FIG. 1 a perspective view of a frame with water tanks and plate springs but without, however, of the (shown only with dot-dash lines) continuous casting mold.
Figure 1A:
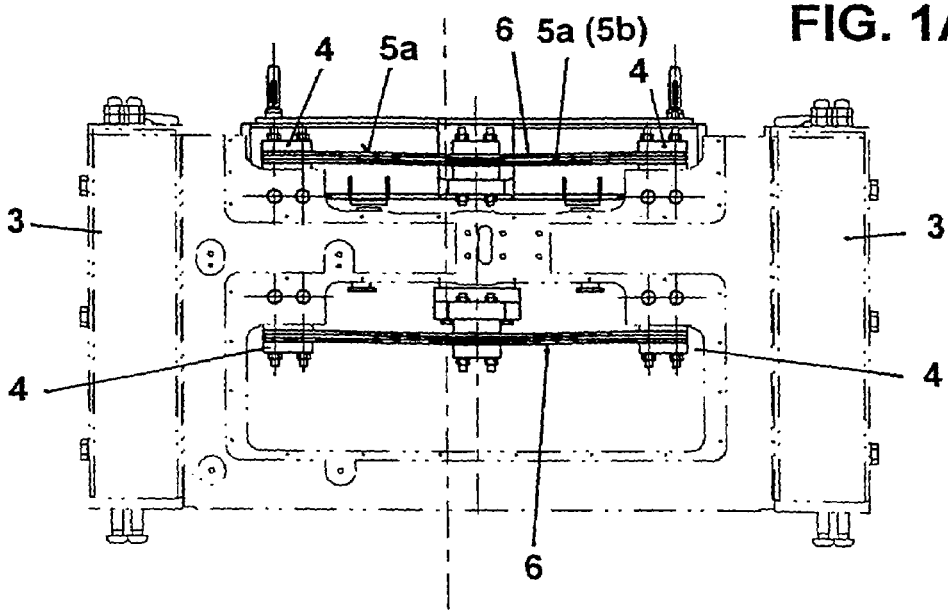
FIG. 1A side view in direction of arrow "A" against spring anchoring.

According to FIGS. 1 and 1*a*, a continuous casting mold 1 is oscillatingly supported in a stationary mold frame 2 that also supports water tanks 3 for feeding and discharging the cooling water. The mold frame has at both ends of the rectangular base form, respective upper and lower pairs of connection or fixed points 4 for springs 5, spring assemblies 5*a*, or spring bundles 5*b* which are shown as plate springs, however, any other polygonal, circular or elliptical cross-section extending primarily in a longitudinal direction can be used. The springs 5 can form, when tightly abutting each other, a spring assembly 5*a* or a spring bundle 5*b*. It is advantageous to use springs 5, spring assemblies 5*a*, or spring bundles 5*b* from fiber composites 6 having operational temperatures of about 20-80° C., a high corrosion resistance and, therefore, a high fatigue strength for a lasting period, mechanical stability at the given stiffness, and mechanical characteristics similar to those of spring steel.

The used fiber composites 6 consist of carbon or aramide fibers (CFK, AFK) bonded in plastic materials such as matrix material. As a matrix material, carbon can be used.

Figure 2:
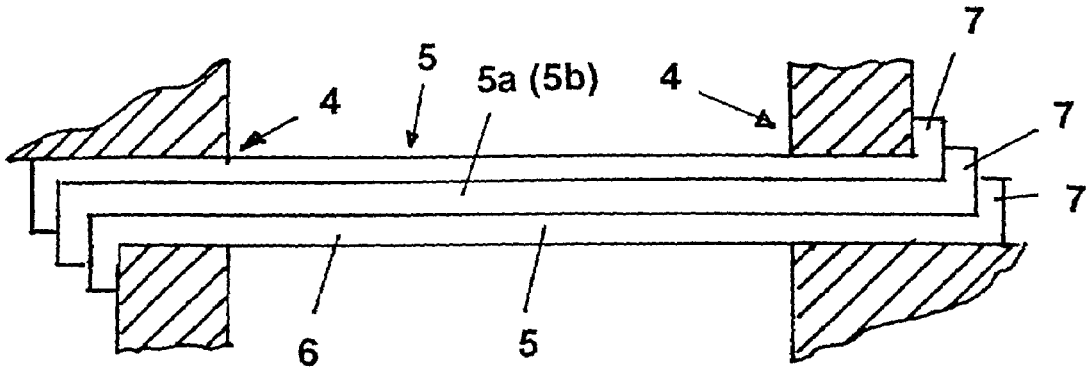
FIG. 2 a partial view through connection or fixed points for springs, spring assemblies, and spring bundles.

According to FIG. 2, the spring ends 7 of the springs 5, spring assemblies 5*a*, or spring bundles 5*b* are flanged in opposite directions and are latched at the fixed point 4.

The spring 5, spring assembly 5*a*, and spring bundle 5*b* can be protected with a thin ceramic layer or be encased.

Figure 3:
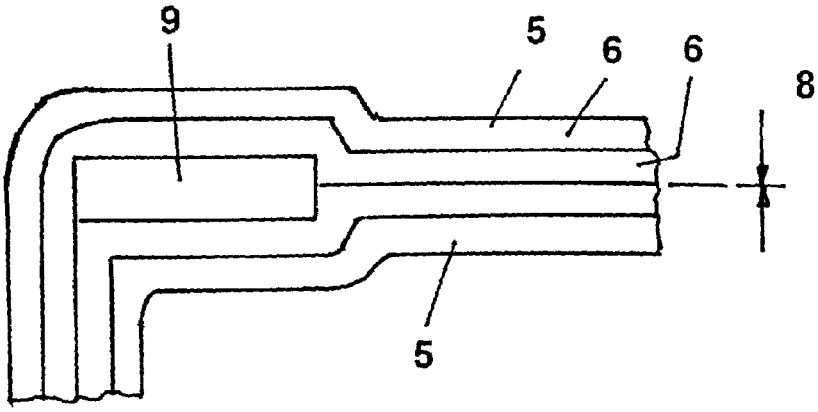
FIG. 3 a partial view through an alternative embodiment of connection or fixed points for springs with a laminated intermediate layer.

Another embodiment, contemplates springs 5, spring assemblies 5*a*, or spring bundles 5*b* of a fiber composite 6 with ceramic components (CSiC—carbon fiber-reinforced silicon carbide matrix composition) integrated in the matrix material. According to FIG. 3, in order to retain a minimal distance between several springs 5, spring assemblies 5*a*, and spring bundles 5*b*, an intermediate layer 9 is laminated in.

A further embodiment contemplates a central core of a polymeric material with a cover of the fiber composite 6 and with a polymeric matrix of fibers extending in a main direction. The cross-section is similar to a rectangle, circle or ellipse.

A still further embodiment contemplates a circular or rectangular tubular shape in which the spring body is formlockingly or forcelockingly inserted.

The cross-section of the spring 5 can be formed by a crosswise laid-on laminate layers and a glass fiber core.

Fiber-reinforced plastic materials with intermediate layers can be formed into a spring 5, with the use of hardened plastic materials, e.g., unsaturated polyester resin, modified epoxy resin, polyurethane resin, or mixtures of such materials.

Other materials for intermediate layers are polyethylene, polypropylene, polyamide or polymethylmethacrylate, and elastomer. These materials contain fibrous filling materials.

An additional embodiment contemplates a matrix metal reinforced by high-strength inorganic ceramic and/or metal fibers with a high module of elasticity.

REFERENCE NUMERALS

1. Continuous Casting Mold
2. Mold Frame
3. Water Tanks
4. Connection or Fixed Points
5. Spring
5*a*. Spring assembly
5*b*. Spring bundle
6. Fiber Composite
7. Spring End
8. Minimal Distance
9. Intermediate Layer

The invention claimed is:

1. An oscillating device in a continuous mold (1) for casting molten metal and supported in a stationary mold frame (2), the oscillating device comprising a plurality of one of springs (5), spring assemblies (5*a*), and spring bundles (5*b*) extending between the stationary mold frame (2) and connection points (4) for supporting the continuous casting mold (1) in the stationary mold frame (2) and set in control oscillations by drive pairs, wherein the plurality of one of springs (5), spring assemblies (5*a*), and spring bundles (5*b*) is formed of fiber composites (6) consisting of carbon or aramide fibers (CFK, AFK) bonded in a plastic material as matrix material for operational temperatures of about 20-80° C., and wherein ends (7) of one of springs (5), spring assemblies (5*a*), and spring bundles (5*b*) are flanged in opposite directions and are fixed in a fixing point (4).

2. An oscillating device according to claim 1, wherein separate or all of the plurality of one of springs (5), spring assemblies (5*a*), and spring bundles (5*b*) are formed of the fiber composites (6).

3. An oscillating device according to claim 2, wherein the plurality of one of springs (5), spring assemblies (5*a*), and spring bundles (5*b*) is formed without coating.

4. An oscillating device according to claim 1, wherein carbon is used as the matrix material.

5. An oscillating device according to claim 1, wherein the plurality of one of spring (5), spring assemblies (5*a*), and spring bundles (5*b*) is one of encased and protected with a thin ceramic coating.

6. An oscillating device according to claim 5, wherein the plurality of one of springs (5), spring assemblies (5*a*), and spring bundles (5*b*) is formed of a fiber composite (6) with ceramic components (CSiC) integrated in the matrix material.

7. An oscillating device according to claim 1, wherein for maintaining a minimal distance between the plurality of one of springs (5), spring assemblies (5*a*), and spring bundles (5*b*), intermediate layers (9) are laminated in.

* * * * *